US009297508B2

(12) United States Patent
Yagi

(10) Patent No.: US 9,297,508 B2
(45) Date of Patent: Mar. 29, 2016

(54) VEHICULAR LAMP

(75) Inventor: Takayuki Yagi, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 14/240,451

(22) PCT Filed: Aug. 2, 2012

(86) PCT No.: PCT/JP2012/069737

§ 371 (c)(1),
(2), (4) Date: Feb. 24, 2014

(87) PCT Pub. No.: WO2013/027555

PCT Pub. Date: Feb. 28, 2013

(65) Prior Publication Data

US 2014/0226356 A1 Aug. 14, 2014

(30) Foreign Application Priority Data

Aug. 25, 2011 (JP) ..... 2011-183484

(51) Int. Cl.
*F21S 8/10* (2006.01)
*F21W 101/10* (2006.01)

(52) U.S. Cl.
CPC ..... *F21S 48/1275* (2013.01); *F21S 48/1154* (2013.01); *F21S 48/1258* (2013.01); *F21S 48/1283* (2013.01); *F21W 2101/10* (2013.01)

(58) Field of Classification Search
CPC ..... F21V 5/04; F21V 7/0091; F21V 5/02; F21V 5/00; F21Y 2101/00; F21Y 2101/02; G02B 19/0061; G02B 3/08; G02B 19/0066; G02B 2006/12102; G02B 6/003; G02B 6/4206; F21S 48/1329; F21S 48/215; F21S 48/234; F21S 48/236; B60Q 1/26; B60Q 1/302; G02F 1/133603
USPC ..... 362/268, 308, 309, 333–335, 338–340, 362/507, 509, 520, 522
See application file for complete search history.

(56) References Cited

U.S. PATENT DOCUMENTS 4,654,761 A * 3/1987 Walsh ..... 362/521
4,703,405 A * 10/1987 Lewin ..... 362/333
5,676,453 A * 10/1997 Parkyn et al. ..... 362/260
5,801,889 A * 9/1998 Meyers et al. ..... 359/743
5,964,525 A * 10/1999 Albou ..... 362/522

(Continued)

FOREIGN PATENT DOCUMENTS

DE 102004008296 A1 9/2005
EP 2237080 A1 10/2010

(Continued)

OTHER PUBLICATIONS

International Search Report dated Oct. 2, 2012 issued in International Application No. PCT/JP2012/069737 (PCT/ISA/210).

(Continued)

*Primary Examiner* — Hargobind S Sawhney
(74) *Attorney, Agent, or Firm* — Sughrue Mion, PLLC

(57) ABSTRACT

A front surface 14*a* of a lens 14 is divided into 48 front surface areas 14*a*1, 14*a*2, 14*a*3 via ridge lines R1 to R5, and a rear surface 14*b* of the lens 14 is divided into 48 rear surface areas 14*b*1, 14*b*2, 14*b*3 via trough lines T1 to T5. The individual rear surface areas 14*b*1, 14*b*2, 14*b*3 are formed so as to have surface shapes which are set so that light from a predetermined point A which is positioned on a light source 12 is caused to reach zones on the individual front surfaces areas 14*a*1, 14*a*2, 14*a*3 which correspond to the individual rear surface areas 14*b*1, 14*b*2, 14*b*3, the zones each lying centrally inwards apart from the ridge lines which define the circumference of each of the front surface areas.

10 Claims, 9 Drawing Sheets

(56) References Cited

U.S. PATENT DOCUMENTS

| | | | | |
|---|---|---|---|---|
| 6,097,549 | A * | 8/2000 | Jenkins et al. | 359/726 |
| 6,212,011 | B1 * | 4/2001 | Lissotschenko et al. | 359/623 |
| 8,136,967 | B2 * | 3/2012 | Weaver et al. | 362/327 |
| 2006/0034082 | A1 * | 2/2006 | Park et al. | 362/268 |
| 2007/0236952 | A1 * | 10/2007 | Chinniah et al. | 362/538 |
| 2009/0268466 | A1 * | 10/2009 | Allegri | 362/268 |

FOREIGN PATENT DOCUMENTS

| | | | |
|---|---|---|---|
| FR | 2727742 | A1 | 6/1996 |
| JP | 9-180516 | A | 7/1997 |
| JP | 11-504124 | A | 4/1999 |
| JP | 2006-127819 | A | 5/2006 |
| JP | 2008-140667 | A | 6/2008 |
| JP | 2008-262755 | A | 10/2008 |
| JP | 2009-43543 | A | 2/2009 |

OTHER PUBLICATIONS

Written Opinion dated Oct. 2, 2012 issued in International Application No. PCTJP2012/069737 (PCT/ISA/237).

Communication from the European Patent Office issued Oct. 26, 2015 in a counterpart European Application No. 12825197.2.

* cited by examiner

VEHICULAR LAMP

TECHNICAL FIELD

The present invention relates to a vehicular lamp configured to form a predetermined lamp light distribution pattern by controlling the deflection of light emitted from a light source by a lens disposed at a front side of the light source.

BACKGROUND ART

Conventionally, as described in, for example, "Patent Literature 1" and "Patent Literature 2," there has been known a vehicular lamp which is configured to form a predetermined lamp light distribution pattern by controlling the deflection of light emitted from a light source such as a light emitting element by a lens disposed at a front side of the light source.

In the vehicular lamp described in "Patent Literature 1," the lens is formed into a planoconvex lens, and the light emitting element is disposed near a rear focal point.

On the other hand, in the vehicular lamp described in "Patent Literature 2," the lens is described as being formed by connecting in a circumferential direction four lens pieces of the same shape which are each cut into a sector at a predetermined central angle from an elliptic lens having a front convex elliptic surface and a rear concave elliptic surface.

PRIOR ART LITERATURE

Patent Literature

Patent Literature 1:, JP-A-2006-127819
Patent Literature 2:, JP-A-2009-43543

SUMMARY OF THE INVENTION

Problem that the Invention is to Solve

In recent years, from the viewpoint of achieving an improvement in vehicle design, there are increasing demands for novel designs for lenses which are disposed at a front side of a light source.

In the lens described in "Patent Literature 2" above, the front surface thereof is divided into the plurality of front areas by ridge lines, and therefore, it is possible to produce the lens design which is different from a lens design in which a front surface of the lens is formed by a single curved surface.

In the configuration described in "Patent Literature 2, however, only the lens design is obtained in which the ridge lines extending radially are formed on the front surface of the lens, and no other special designs than that can be produced.

In addition, in the vehicular lamp described in "Patent Literature 2" above, when assuming that the light source of the lamp is a point light source which is disposed at the rear focal point of the lens, light which is incident on the rear surface of one of the four lens pieces which make up the lens reaches the front surface of the same lens piece. However, the light source has a certain size, and light from positions lying apart from the rear focal point also reaches the lens. Therefore, light which is incident on the rear surface of any one of the four lens pieces does not always reach the front surface of the same lens piece, and as this occurs, part of the light which reaches the front surface of the different lens piece is emitted in a direction which differs from the expected emitting direction from the front surface of the lens piece. Because of this, the control of deflection of light from the light source cannot be performed accurately.

The invention has been made in view of these situations, and an object thereof is to provide a vehicular lamp configured to form a predetermined lamp light distribution pattern by controlling the deflection of light emitted from a light source by a lens which can provide a novel lens design while ensuring that the deflection of the light emitted from the light source can be controlled accurately by the lens.

Means for Solving the Problem

A vehicular lamp of the invention comprises:

a light source; and a lens disposed at a front side of the light source and configured to form a predetermined lamp light distribution pattern by controlling a deflection of light emitted from the light source, wherein a front surface of the lens is divided into a plurality of front surface areas via ridge lines, wherein a rear surface of the lens is divided into a plurality of rear surface areas by trough lines which is the same number as the plurality of front surface areas, wherein the rear surface areas are formed so as to have surface shapes which are set so that light which is emitted from a position situated on the light source or near the light source and then incident on the lens from the rear surface areas is caused to reach zones on the plurality of front surface areas which correspond to the plurality of rear surface areas, the zones each lying centrally inwards apart from the ridge lines which define the circumference of each of the front surface areas, wherein the front surface areas are formed so as to have surface shapes which are set so that light which is emitted from the predetermined point and then reaches the front surface areas via the corresponding rear surface areas is emitted into predetermined directions from the individual front surface areas, and wherein the lamp light distribution pattern is formed as a combined light distribution pattern of a plurality of light distribution patterns which are formed by a combination of the individual rear surface areas and the individual front surface areas.

The kind of the "light source" is not particularly limited and also the concrete size and orientation thereof is not limited.

There is imposed no specific limitation on the number and shape of front surface areas into which the "front surface of the lens" is to be divided, as long as the "front surface of the lens" is divided into the plurality of front surface areas via the ridge lines. Additionally, there is imposed no specific limitation on the surface shape of each of the "front surface areas."

There is imposed no specific limitation on the shape and size of the rear surface areas into which the "rear surface of the lens" is divided, as long as the "rear surface of the lens" is divided into the plurality of rear surface areas via the trough lines which is the same number as the plurality of front surface areas and the individual rear surface areas are formed so as to have the surface shapes which are set so that the light which is emitted from the predetermined point and then incident on the lens from the rear surface areas is caused to reach the zones on the front surface areas which correspond to the rear surface areas, the zones each lying centrally inwards apart from the ridge lines which define the circumference of each of the front surface areas.

MODE FOR CARRYING OUT THE INVENTION

Hereinafter, an embodiment of the invention will be described by the use of the drawings.

Figure 1:
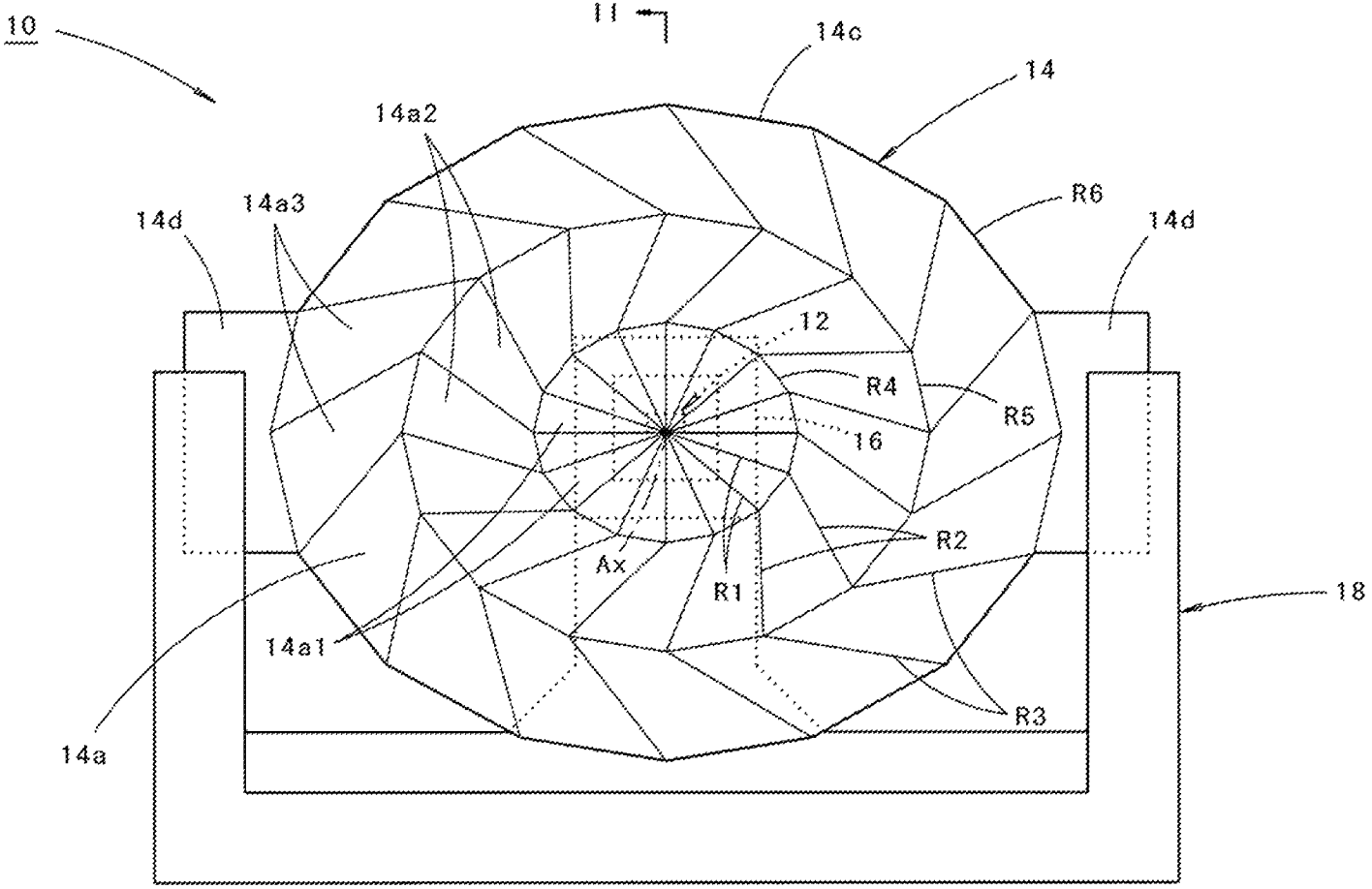
FIG. 1 is a front view of a vehicular lamp according to an embodiment of the invention.
Figure 2:
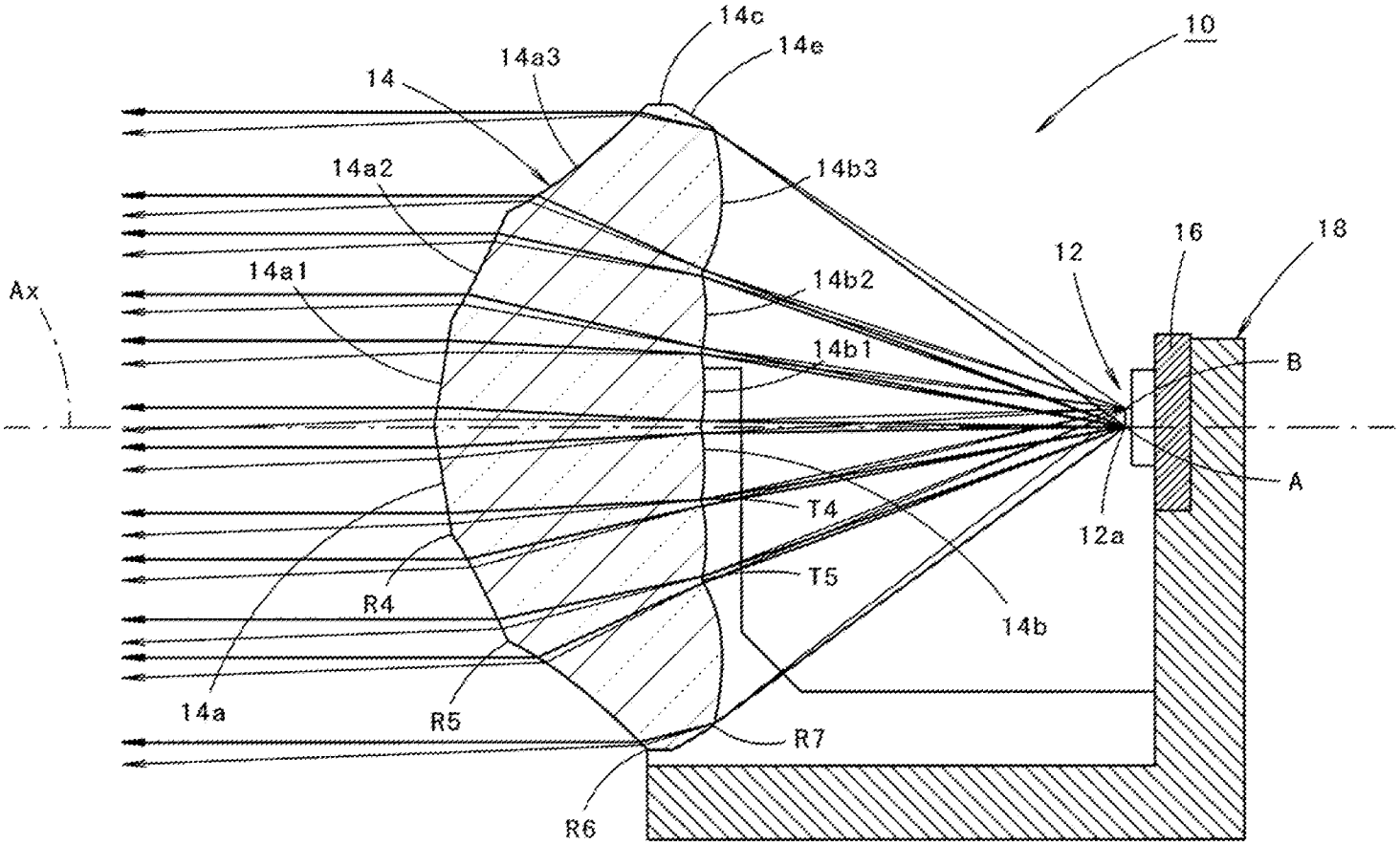
FIG. 2 is a sectional view taken along the line II-II in FIG. 1.

FIG. 1 is a front view of a vehicular lamp 10 according to an embodiment of the invention, and FIG. 2 is a sectional view taken along the line II-II in FIG. 1. In addition, FIG. 3 is a perspective view showing main constituent elements of the vehicular lamp 10.

Figure 3:
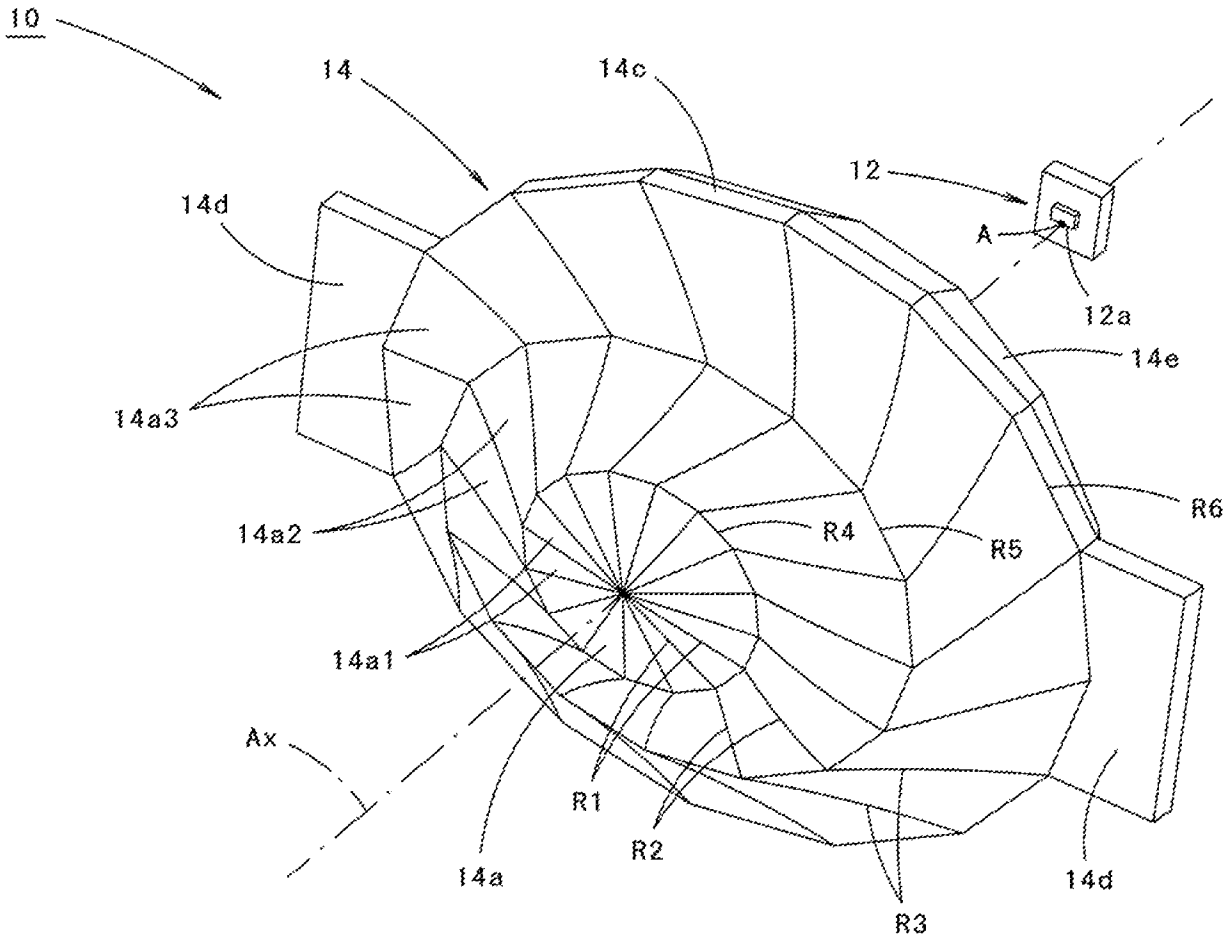
FIG. 3 is a perspective view showing main constituent elements of the vehicular lamp.

As shown in FIGS. 1 to 3, this vehicular lamp 10 includes a light source 12 and a lens 14 which is disposed at a front side of the light source 12, whereby a predetermined lamp light distribution pattern is formed by controlling the deflection of light emitted from the light source 12 by the lens 14.

This vehicular lamp 10 is used as a lamp unit for a vehicle headlamp in such a state that the vehicular lamp 10 is incorporated in a lamp body or the like, which is not shown, in such a way that an optical axis thereof can be controlled. Additionally, in this vehicular lamp 10, at a stage where the optical axis control has been completed, an optical axis Ax of the lens 14 is set to extend in a direction which is inclined downwards at an angle of the order of 0.5, to 0.6° with respect to a front-to-rear direction of the vehicle.

The light source 12 is a light emitting chip of a white light emitting diode and has a light emitting surface of a horizontally elongated rectangular shape (for example, a rectangle which is approximately 1, mm wide and 2, mm long). Then, this light source 12 is disposed with the light emitting surface thereof directed in the direction of the front of the lamp and with a predetermined point A, which is positioned at a transverse center of a lower edge 12*a*, thereof, positioned on the optical axis Ax.

This light source 12 is supported by a lens holder 18 via light source support member 16.

The lens 14 has a lens shape which approximates to a shape which results from horizontally elongating a planoconvex aspheric lens for which a front surface is convex and a rear surface is plane.

Specifically, this lens 14 has a substantially horizontally elongated elliptic shape as its external shape when the lamp is seen from the front thereof, and the shape is set to a shape of twofold rotation symmetry with respect to the optical axis Ax. Then, this lens 14 is supported by the lens holder 18 at a pair of tabs 14*d*, formed at both left- and right-hand side portions of an outer circumferential surface 14*c*, thereof A front surface 14*a*, of this lens 14 is divided into 48, front surface areas 14*a*1, 14*a*2, 14*a*3 by ridge lines R1 to R5.

The front surface areas 14*a*1 are 16, areas which are situated in a central portion of the front surface 14*a*. When the lamp is seen from the front thereof, the individual surface areas 14*a*1 are triangular areas which are defined by 16, ridge lines R1 which extend radially about the optical axis Ax and ridge lines R4 which extend along a polygon which is inscribed in a horizontally elongated ellipse which is centered at the optical axis Ax, each having a concavely curved surface shape.

The front surface areas 14*a*2 are 16, areas which are situated in an annular portion lying on an outer circumferential side of the 16, surface areas 14*a*1. When the lamp is seen from the front thereof, the individual surface areas 14*a*2 are quadrangular areas which are defined by the ridge lines R4, 16, ridge lines R2 which extend from positions at outer circumferential ends of the ridge lines R1 in directions which are inclined in a clockwise direction from a radial direction with respect to the optical axis Ax, and ridge lines R5 which extend along a polygon which is inscribed in a horizontally elongated ellipse which is centered at the optical axis Ax, each having a concavely curved surface shape.

The front surface areas 14*a*3 are 16, areas which are situated in an annular portion lying on an outer circumferential side of the 16, front surface areas 14*a*2. When the lamp is seen from the front thereof, the individual front surface areas 14*a*3 are quadrangular areas which are defined by the ridge lines R5, 16, ridge lines R3 which extend from positions at outer circumferential ends of the ridge lines R2 in directions which are inclined in a counterclockwise direction from the radial direction with respect to the optical axis Ax, and ridge lines R6 which extend along a polygon which is inscribed in a horizontally elongated ellipse which is centered at the optical axis Ax, each having a concavely curved surface shape. In this case, the ridge lines R6 constitute a boundary between the 16, front surface areas 14*a*3 and the outer circumferential surface 14*c*, of the lens 14.

Figure 4:
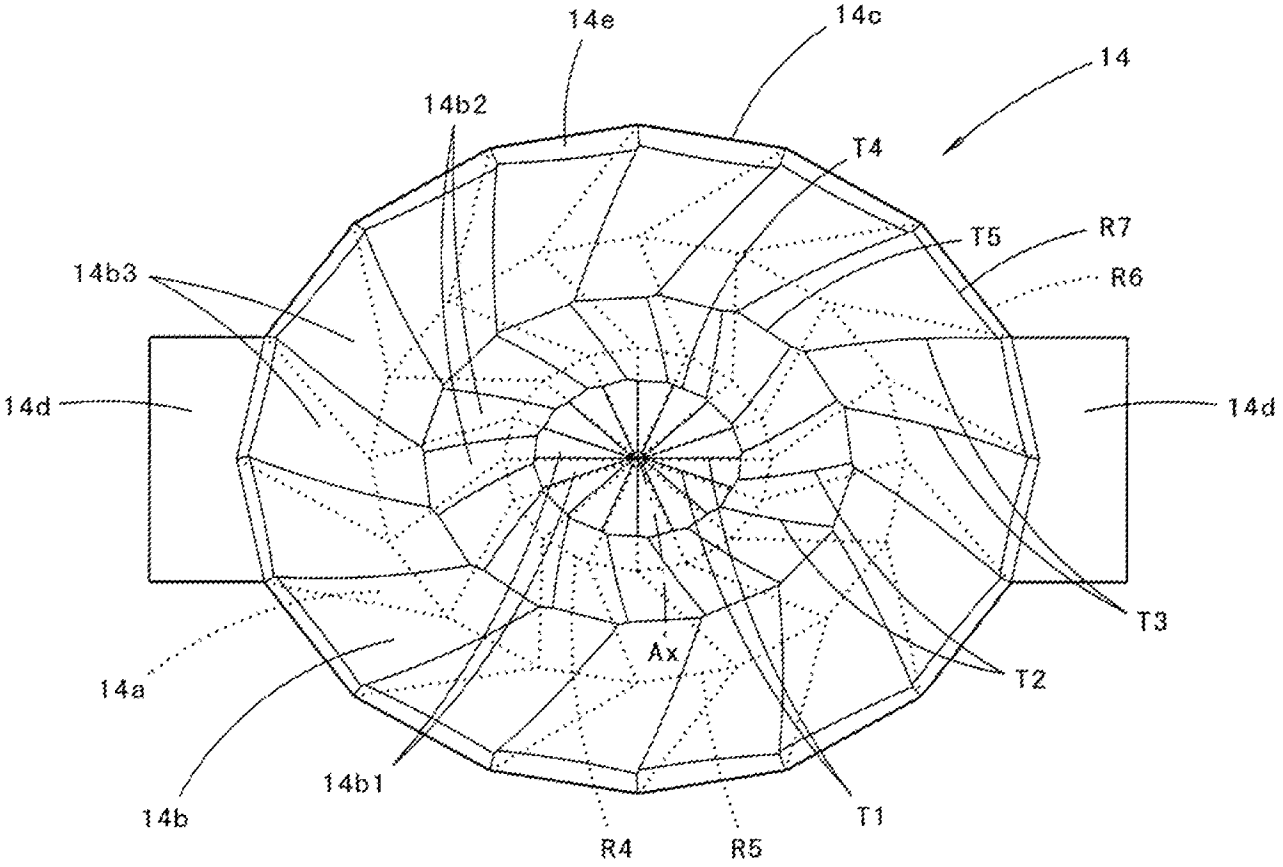
FIG. 4 is a view resulting when a lens is seen from the rear thereof.
Figure 5:
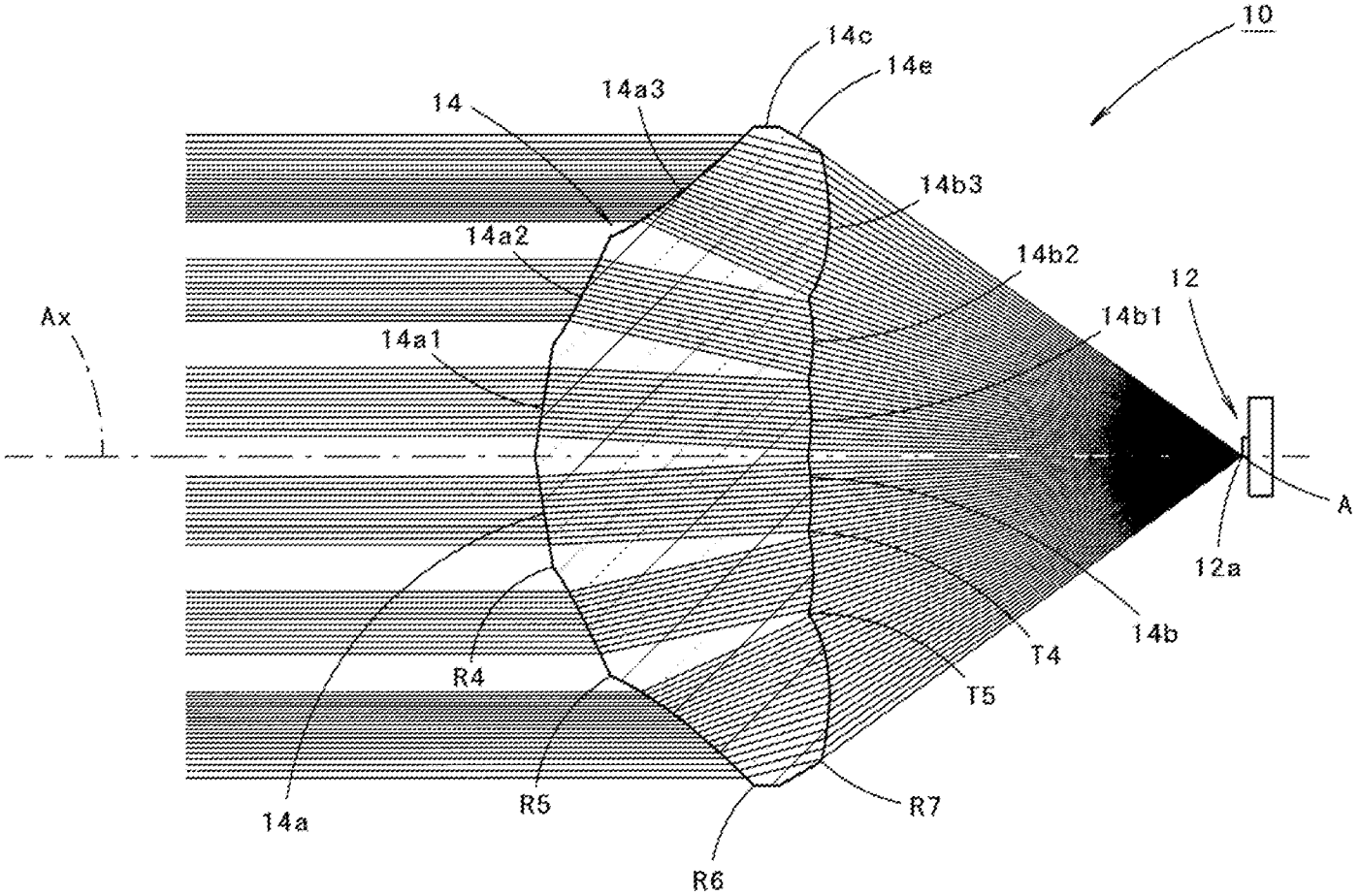
FIG. 5 is a side sectional view showing an optical operation of the lens.
Figure 6:
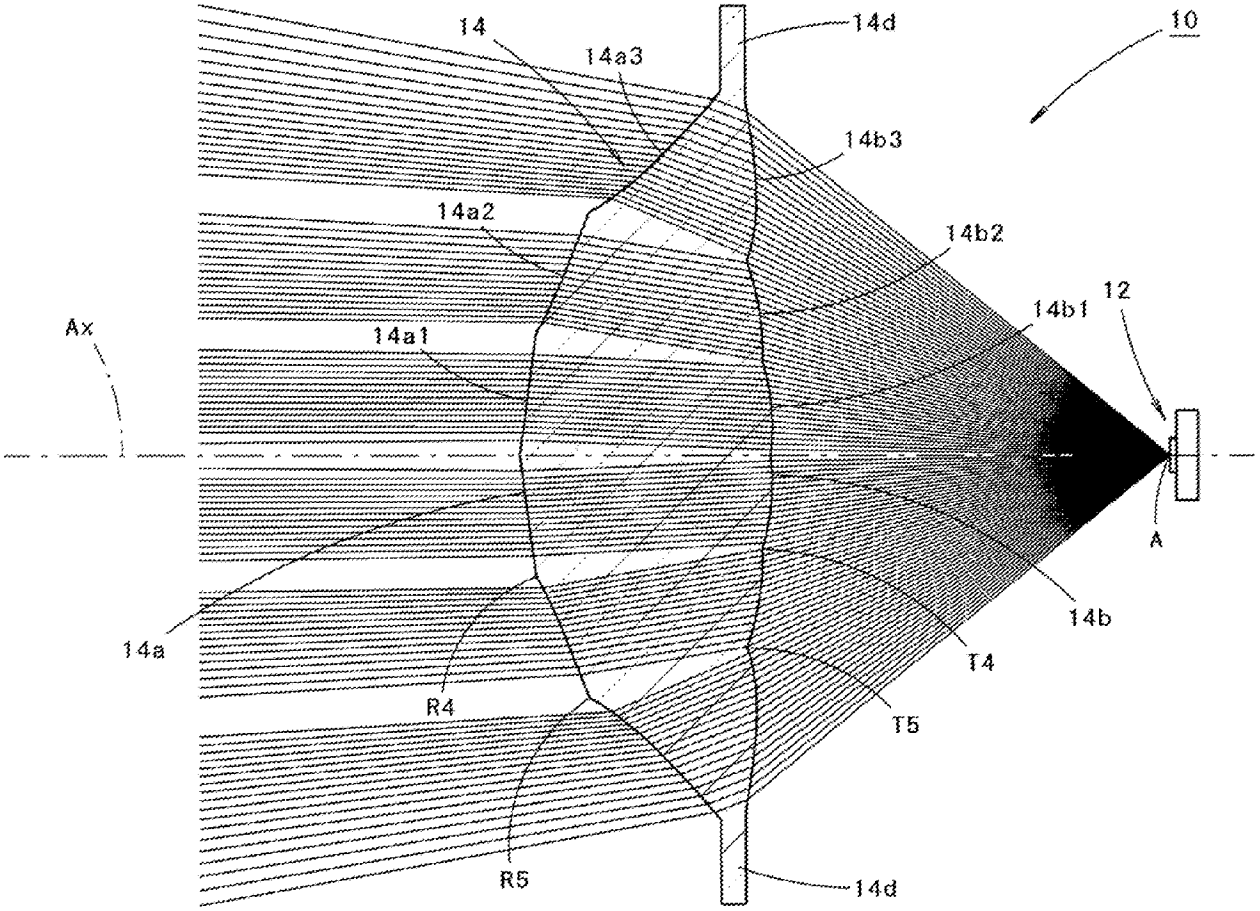
FIG. 6 is a horizontally sectional view showing the optical operation of the lens.
Figure 7:
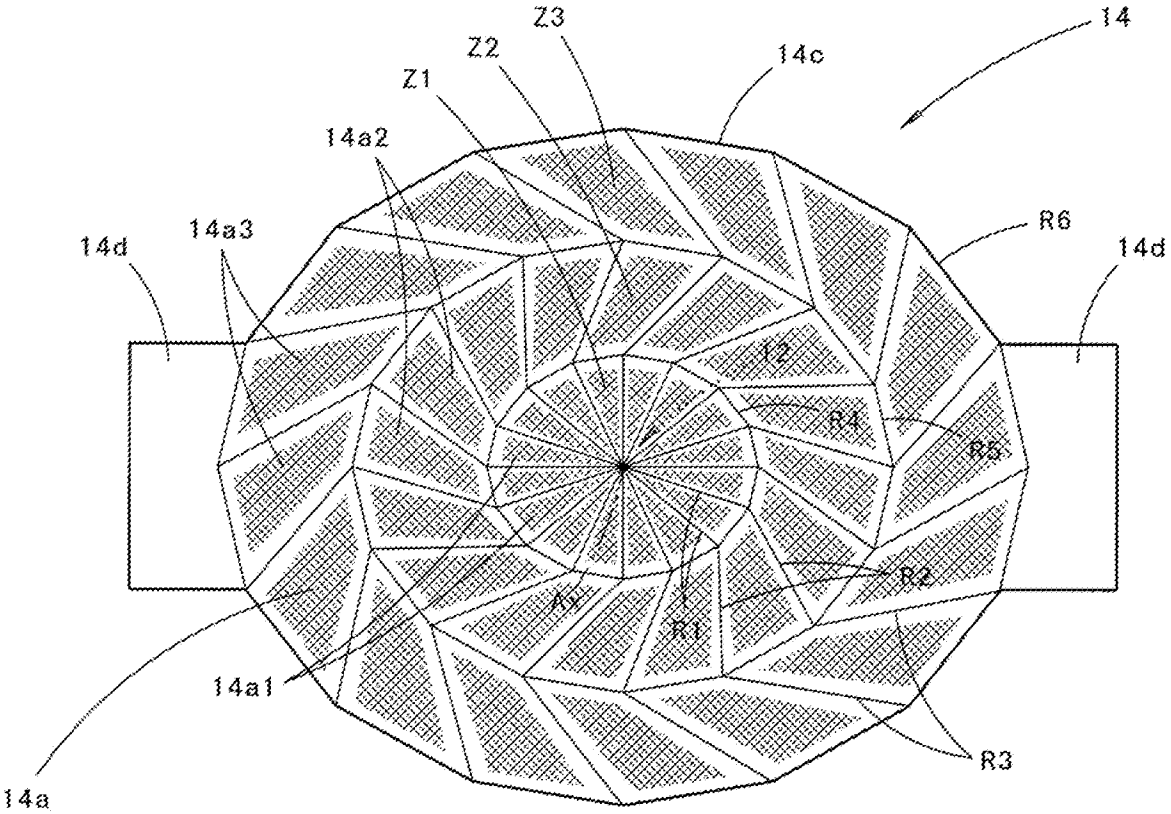
FIG. 7 is a front view showing an optical operation of the lens.

FIG. 4 is a view resulting when the lens 14 is seen from the rear thereof In addition, FIGS. 5, 6 and 7 are a side sectional view, a horizontally sectional view and a front view of the lens 14, respectively, which show an optical operation of the lens 14.

As shown in FIGS. 4 to 7, a rear surface 14*b*, of the lens 14 is divided into 48 rear surface areas 14*b*1, 14*b*2, 14*b*3 via trough lines T1 to T5.

These 48, rear surface areas 14*b*1, 14*b*2, 14*b*3 are formed so as to be positioned substantially at the rear of the 48, front surface areas 14*a*1, 14*a*2, 14*a*3, respectively.

The rear surface areas 14*b*1 are 16, areas which are positioned in a central portion of the rear surface 14*b*. When the lamp is seen from the rear thereof, the individual rear surface areas 14*b*1 are substantially triangular areas which are defined by 16, trough lines T1 which extend radially about the optical axis Ax and trough lines T4 which extend along a polygon which is inscribed in a horizontally elongated ellipse which is centered at the optical axis Ax, each having a convexly curved surface shape. In this case, when the lamp is seen from the rear thereof, the individual trough lines T1 are formed in positions where they are substantially superposed on the individual ridge lines R1, and the trough lines T4 are formed in positions where they are closer to the optical axis Ax than the ridge lines R4.

The curvature of the convexly curved surfaces which make up the surface shape of the individual rear surface areas 14*b*1 is set so that light which is emitted from the predetermined point A and then incident on the lens 14 from the rear surface areas 14*b*1 reaches zones (shaded zones in FIG. 7) Z1 on the individual front surface areas 14*a*1 which corresponds to the individual rear surface areas 14*b*1 (that is, the front surface areas situated substantially in front of the corresponding rear surface areas), the zones Z1 each lying centrally inwards apart from the ridge lines R1, R4 which define each front surface area 14*a*1.

The rear surface areas 14*b*2 are 16, areas which are situated in an annular portion lying on an outer circumferential side of the 16, rear surface areas 14*b*1. When the lamp is seen from the rear thereof, the individual rear surface areas 14*b*2 are substantially quadrangular areas which are defined by the trough lines T4, 16, trough lines T2 which extend in directions which are inclined in a counterclockwise direction from a radial direction with respect to the optical axis Ax from positions on the trough lines T4 which are slightly offset in the counterclockwise direction from outer circumferential ends of the individual trough lines T1, and trough lines T5 which extend along a substantially polygonal shape which is inscribed in a horizontally elongated ellipse which is centered at the optical axis Ax, each having a convexly curved surface shape. In this case, the trough lines T5 are formed in positions where they are closer to the optical axis Ax than the ridge lines R5.

The curvature of the convexly curved surfaces which make up the surface shape of the individual rear surface areas 14*b*2 is set so that light which is emitted from the predetermined point A and then incident on the lens 14 from the rear surface areas 14*b*2 reaches zones (shaded zones in FIG. 7) Z2 on the individual front surface areas 14*a*2 which corresponds to the individual rear surface areas 14*b*2, the zones Z2 each lying centrally inwards apart from the ridge lines R4, R2, R5 which define each front surface area 14*a*2.

The rear surface areas 14*b*3 are 16, areas which are situated in an annular portion lying on an outer circumferential side of the 16, rear surface areas 14*b*2. When the lamp is seen from the rear thereof, the individual rear surface areas 14*b*3 are substantially quadrangular areas which are defined by the trough lines T5, 16, trough lines T3 which extend in directions which are inclined in a clockwise direction from the radial direction with respect to the optical axis Ax from positions on the trough lines T5 which are slightly offset in the clockwise direction from outer circumferential ends of the individual trough lines T2, and ridge lines R7 which extend along a substantially polygonal shape which is inscribed in a horizontally elongated ellipse which is centered at the optical axis Ax, each having a convexly curved surface shape. In this case, the ridge lines R7 are formed closer to the optical axis Ax than the ridge lines R6.

The curvature of the convexly curved surfaces which make up the surface shape of the individual rear surface areas 14*b*3 is set so that light which is emitted from the predetermined point A and then incident on the lens 14 from the rear surface areas 14*b*3 reaches zones (shaded zones in FIG. 7) Z3 on the individual front surface areas 14*a*3 which corresponds to the individual rear surface areas 14*b*3, the zones Z3 each lying centrally inwards apart from the ridge lines R5, R3, R6 which define each front surface area 14*a*3.

It is noted that 16, connecting areas 14*e*, are formed between the 16, rear surface areas 14*b*3 and the outer circumferential surface 14*c*, of the lens 14 at an angle which light from the light source 12 is not incident thereinto.

As shown in FIGS. 5 and 6, the individual front surface areas 14*a*1, 14*a*2, 14*a*3 cause light which is emitted from the predetermined point A and then incident on the lens 14 from the individual rear surface areas 14*b*1, 14*b*2, 14*b*3 to be emitted in a direction which is parallel to the optical axis Ax with respect to a vertical direction. On the other hand, with respect to a horizontal direction, the curvatures of the curved surfaces which make up the surface shapes of the individual front surface areas 14*a*1, 14*a*2 and 14*a*3 are set so that the light is emitted as diffuse light which travels substantially parallel to the optical axis Ax at the individual front surface areas 14*a*1, the light is emitted as diffuse light which travels in directions in which the light travels slight away from the optical axis Ax at the front surface 14*a*2, and the light is emitted as diffuse light which travels in directions in which the light travels farther away from the optical axis Ax at the front surface areas 14*a*3.

As shown in FIG. 2, light which is emitted from the predetermined point A and then incident on the lens 14 from the individual rear surface areas 14*b*1, 14*b*2, 14*b*3 is emitted in the direction which is parallel to the optical axis Ax with respect to the vertical direction, light emitted from a point B at an upper edge of the light source 12 is emitted in directions which are slightly inclined downwards with respect to the direction which is parallel to the optical axis Ax. As this occurs, positions on the individual front surfaces areas 14*a*1, 14*a*2, 14*a*3 from which the light emitted from the point B is emitted are slightly displaced downwards, compared with the light emitted from the predetermined point A. The displacement amount becomes a value which corresponds to a difference between an incidence angle at which the light emitted from the predetermined point A is incident on the lens 14 and an incidence angle at which the light emitted from the point B is incident on the lens 14.

As is clear from FIG. 2, the size of the light emitting surface of the light source 12 is not large enough to cause a change in position on the lens from which light from the light source 12 is emitted, in other words, the light emitted from the point B is also emitted from the front surface areas 14*a*1 14*a*2, 14*a*3 from which the light emitted from the predetermined point A is emitted. In this respect, as is clear from the comparison between FIGS. 5 and 6, light emitted from points situated at both left and right edges of the light source 12 is also emitted from the front surface areas 14*a*1, 14*a*2, 14*a*3 from which the light emitted from the predetermined point A is emitted.

Figure 8:
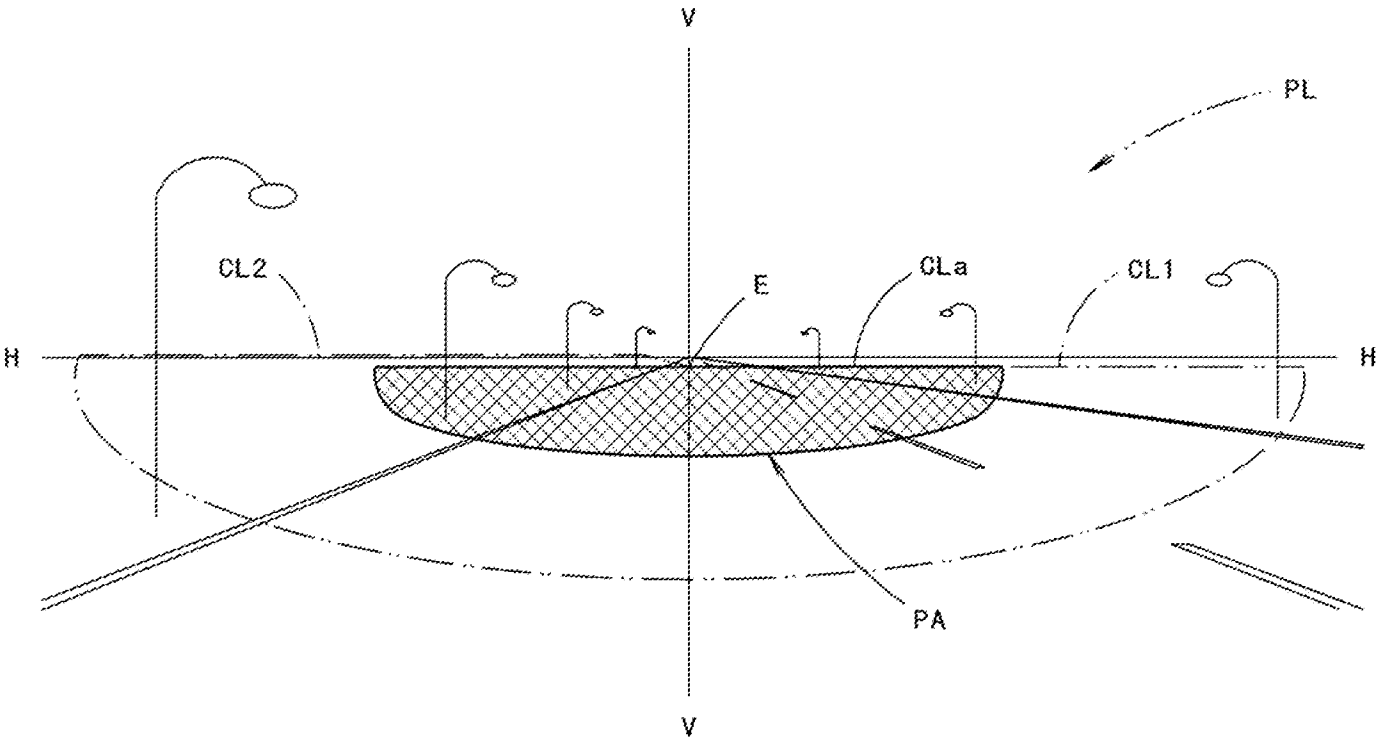
FIG. 8 is a drawing which shows in a perspective fashion a light distribution pattern which is formed on an imaginary vertical screen which is disposed in a position 25, m ahead of the vehicle by light irradiated to the front from the vehicular lamp.

FIG. 8 is a drawing which shows in a perspective fashion a lamp light distribution pattern PA which is formed on an imaginary vertical screen which is disposed in a position 25 in ahead of the vehicle by light irradiated to the front from the vehicular lamp 10.

This lamp light distribution pattern is a light distribution pattern which is formed as part of a low-beam light distribution pattern PL indicated by a chain double-dashed line in FIG. 8.

This low-beam light distribution pattern PL is a low-beam light distribution pattern for a left-hand side traffic which is formed by lights irradiated by the vehicular lamp 10 and the other vehicular lamp which is not shown and has cutoff lines CL1, CL2 which differ in level on left- and right-hand sides along an upper edge thereof These cutoff lines CL1, CL2 extend horizontally in different levels on left- and right-hand sides of a line V-V as a boundary which passes vertically through an extinction point ahead of the lamp. An on-coming vehicle lane portion which lies on the right-hand side of the line V-V is formed as a lower cutoff line CL1, while a subject vehicle lane portion which lies on the left-hand side of the line V-V is formed as an upper cutoff line CL2 which lies on an upper level than the lower cutoff line CL1 via an inclined portion. In addition, in this low-beam light distribution pattern PL, an elbow point E which constitutes a point of intersection between the lower cutoff line CL1 and the line V-V is situated on the order of 0.5, to 0.6° below the extinction point.

The lamp light distribution pattern PA is formed as a combined light distribution pattern of 48, light distribution patterns which are formed by a combination of the individual rear surface areas 14*b*1, 14*b*2, 14*b*3 and the individual front surface areas 14*a*1, 14*a*2, 14*a*3.

This lamp light distribution pattern PA is formed as a horizontally elongated light distribution pattern which is centered at the line V-V by diffusing light emitted from the light source 12 having the horizontally elongated light emitting surface slightly leftwards and rightwards by the lens 14, and has a horizontal cutoff line CLa at an upper end portion thereof This is because the lower edge 12*a*, of the light source 12 extends horizontally, and the predetermined point A which is the transverse center of the lower edge 12*a*, is situated on the optical axis Ax. As this occurs, the horizontal cutoff line CLa is situated on the order of 0.5, to 0.6° below the extinction point, and this is because the optical axis Ax extends in a direction which is inclined downwards at an angle of the order of 0.5, to 0.6° with respect to the front-to-rear direction of the vehicle.

This lamp light distribution pattern PA contributes to an increase in brightness in an area which is centered at the elbow point E in the low-beam light distribution pattern PL and which lie near and below the cutoff lines CL1, CL2.

Next, the working effect of the embodiment will be described.

The vehicular lamp 10 according to this embodiment is configured to form the lamp light distribution pattern PA by controlling the deflection of light emitted from the light source 12 by the lens 14 which is disposed ahead of the light source 12. The front surface 14*a*, of the lens 14 is divided into the 48, front surface areas 14*a*1, 14*a*2, 14*a*3 via the ridge lines RI to R5, while the rear surface 14*b*, thereof is divided into the 48, rear surface areas 14*b*1, 14*b*2, 14*b*3 via the trough lines T1 to T5, and therefore, the following working effect can be obtained.

Namely, by dividing the front surface 14*a*, of the lens 14 into the 48, front surface areas 14*a*1, 14*a*2, 14*a*3 via the ridge lines R1 to R5, a lens design can be produced which is different from a design produced when the front surface 14*a*, is formed by a single curved surface. On top of that, by diving the rear surface 14*b*, of the lens 14 is divided into the 48, rear surface areas 14*b*1, 14*b*2, 14*b*3 which are the same in number as the 48, front surface front surface areas 14*a*1, 14*a*2, 14*a*3, a crystal touch can be imparted to the lens 14, thereby making it possible to enhance the novelty of the lens design.

As this occurs, the individual rear surface areas 14*b*1, 14*b*2, 14*b*3 are formed so as to have the surface shapes which are set so that the light which is emitted from the predetermined point A situated on the light source 12 and then incident on the lens 14 from the rear surface areas 14*b*1, 14*b*2, 14*b*3 is caused to reach the zones Z1 to Z3 which lie centrally inwards apart from the ridge lines R1 to R6 on the individual front surface areas 14*a*1, 14*a*2, 14*a*3 which correspond, respectively to the rear surface areas 14*b*1, 14*b*2, 14*b*3. In addition, as to the light which is emitted from the positions on the light source 12 which lie apart from the predetermined point A to reach the lens 14, the difference between the incidence angle at which the light from those position is incident on the lens 14 and the incidence angle at which the light emitted from the predetermined point A is incident on the lens 14 is set to the smaller value than the angles which correspond to spaces defined between the ridge lines R1 to R6 and the zones Z1 to Z3 which lie centrally inwards apart from those ridge lines. This enables the whole of the light which is emitted from the light source 12 and then incident on the lens 14 from the individual rear surface areas 14*b*1, 14*b*2, 14*b*3 to reach the front surface areas 14*a*1, 14*a*2, 14*a*3 which correspond to the rear surface areas 14*b*1, 14*b*2, 14*b*3, respectively. Then, this enables, in turn, the deflection of the light from the light source 12 to be controlled accurately.

In addition, the individual front surface areas 14*a*1, 14*a*2, 14*a*3 are formed so as to have the surface shapes which are set so that the light which is emitted from the predetermined point A and then reaches the front surface areas 14*a*1, 14*a*2, 14*a*3 via the corresponding rear surface areas 14*b*1, 14*b*2, 14*b*3 is emitted individually in the predetermined directions from the front surface areas 14*a*1, 14*a*2, 14*a*3. This enables the lamp light distribution pattern PA, which is the combined light distribution pattern of the 48 light distribution patterns which are formed as a result of the combination of the individual rear surface areas 14*b*1, 14*b*2, 14*b*3 and the individual front surface areas 14*a*1, 14*a*2, 14*a*3, to be formed into the shape and with the light intensity distribution which are expected initially.

In this way, according to the embodiment, in the vehicular lamp 10 which is configured to form the predetermined lamp light distribution pattern PA by controlling the deflection of the light emitted from the light source 12 by the lens 14, the novel design can be imparted to the lens 14 while enabling the deflection of light emitted from the light source 12 to be controlled accurately by the lens 14.

In particular, in this embodiment, the novelty of the lens design can be enhanced since the front surface 14*a*, of the lens 14 is divided into the 48, rear surface areas 14*b*1, 14*b*2, 14*b*3 by the 16, ridge lines R1, R2, R3 which extend in the radial direction in a zigzag fashion and the two ridge lines R4, R5 which extend concentrically with the ridge line R6 which constitutes the boundary with the outer circumferential surface 14*c*, of the lens 14.

In the embodiment, while the predetermined point A is described as being situated on the lower edge 12*a*, of the light source 12, a configuration can be adopted in which the predetermined point A is situated in any other position on the light source 12 or a position out of the light source 12.

In the embodiment, while the front surface 14*a*, of the lens 14 is divided into the 48, front surface areas 14*a*1, 14*a*2, 14*a*3, a configuration can, of course, be adopted in which the front surface 14*a*, is divided into any other numbers than this number, and a configuration can also be adopted in which the front surface 14*a*, is divided into front surface areas having different shapes from those of the 48, front surface areas 14*a*1, 14*a*2, 14*a*3.

In the embodiment, while all the 48, front surface areas 14*a*1, 14*a*2, 14*a*3 are described as having the concavely curved front surfaces, a configuration can be adopted in which part or all the front surface areas have flat or convexly curved surfaces. Further, a configuration can be adopted in which a difference in level is formed in part or all of the ridge lines R1 to R5.

In the embodiment, while the vehicular lamp 10 is described as being configured to control the deflection of light emitted from the light source 12 by the lens 14, the vehicular lamp 10 can be configured as a so-called projector-type vehicular lamp in which light from a light source 12 which is disposed further rearwards than the predetermined point A is reflected towards a lens 14 by a reflector, not shown.

Next, a modified example made to the embodiment described above will be described.

Figure 9:
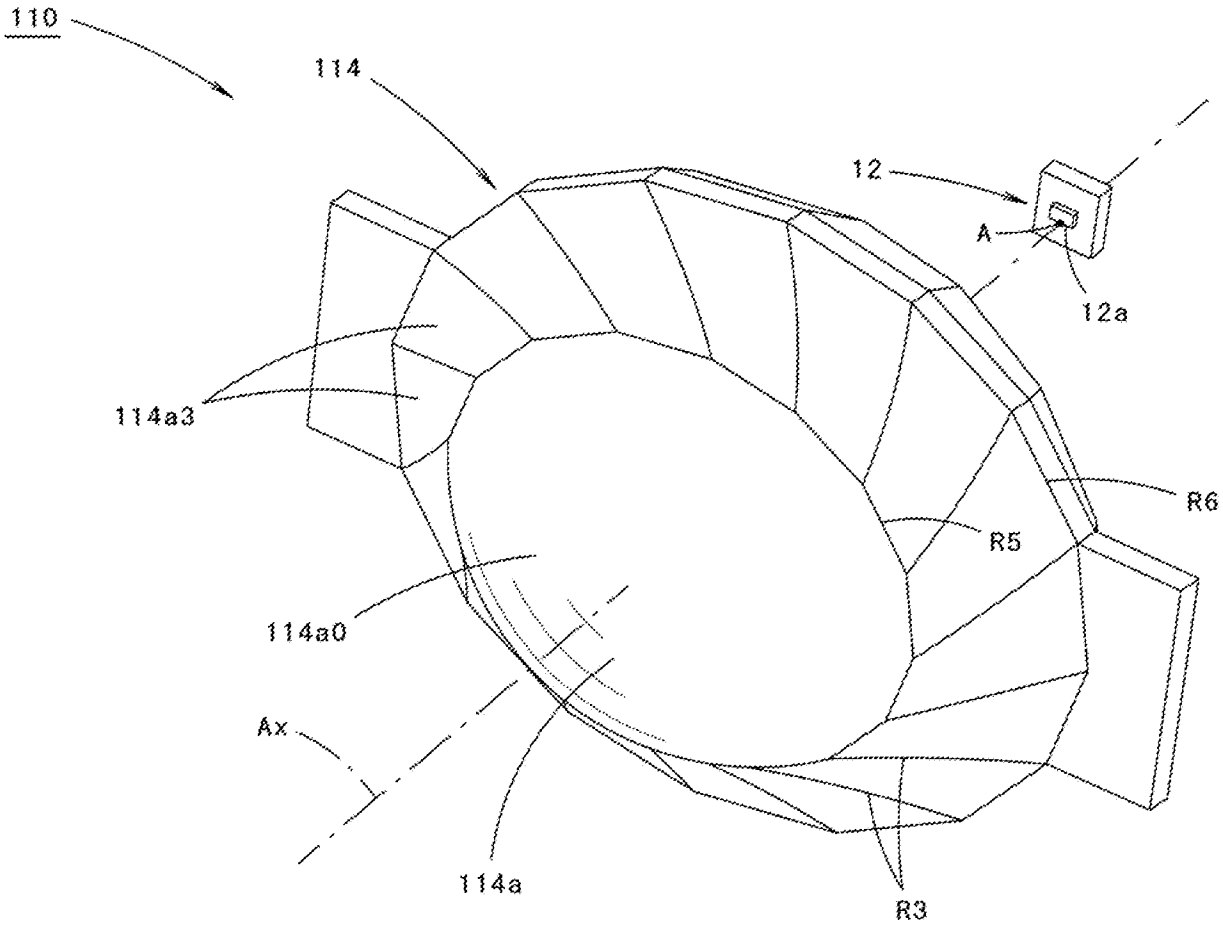
FIG. 9 is a similar drawing to FIG. 3, which shows a modified example of the embodiment above.

FIG. 9 is a similar drawing to FIG. 3, which shows a vehicular lamp 110 according a modified example of the embodiment above.

As shown in FIG. 9, although a basic configuration of the vehicular lamp 110 according to this modified example is similar to that of the embodiment described above, the configuration of a lens 114 is partially different from that of the embodiment.

Namely, in the lens 114 of this modified example, 16, front surface areas 114*a*3 which are similar to the 16, front surface areas 14*a*3 of the embodiment are formed as quadrangular areas which are defined by ridge lines R5 and 16, ridge lines R3 and ridge lines R6 in a circumferentially outermost annular portion on a front surface 114*a*, thereof. However, a portion of the front surface 114*a*, which lies radially inwards of the circumferentially outermost annular portion is not formed as the 16 front surface areas 14*a*1 and the 16, front surface areas 14*a*2 of the embodiment above but is formed as a single horizontally elongated elliptic surface area 114*a*0.

In addition, also, as to a rear surface of this lens 114, 16, rear surface areas which are similar to the 16, rear surface areas 14*b*3 of the embodiment above are formed as substantially quadrangular shapes in a circumferentially outermost portion. However, a portion of the rear surface which lies radially inwards of the circumferentially outermost annular portion is not formed as the 16, rear surfaces areas 14*b*1 and the 16, rear surface areas 14*b*2 of the embodiment above but is formed as a flat area.

Also, when the configuration of this modified example is adopted, the novel design can be imparted to the lens 114 while enabling the deflection of light emitted from the light source 12 to be controlled accurately by the lens 114.

The numeric values shown as the specifications of the vehicular lamps in the embodiment and its modified example are only the examples, and hence, these numeric values may, of course, be set to different values as required.

While the invention has been described in detail by reference to the specific form, it is obvious to those skilled in the art to which the invention pertains that various alterations or modifications can be made thereto without departing from the spirit and scope of the invention.

This patent application is based on the prior Japanese Patent Application (No. 2011-183484) filed on Aug. 25, 2011, the entire contents of which are incorporated herein by reference. In addition, all the references cited herein are incorporated as a whole.

DESCRIPTION OF REFERENCE NUMERALS AND CHARACTERS

10, 110 vehicular lamp
12 light source
12*a*, lower edge
14, 114 lens
14*a*,, 114*a*, front surface
14*a*1, 14*a*2, 14*a*3, 114*a*3 front surface area
14*b*, rear surface
14*b*1, 14*b*2, 14*b*3 rear surface area
14*c*, outer circumferential surface
14*d*, tab
14*e*, connecting area
16 light source support member
18 lens holder
114*a*0 horizontally elongated elliptic surface area
A predetermined point
Ax optical axis
B point at upper edge
CL1 lower cutoff line
CL2 upper cutoff line
CLa horizontal cutoff line
E elbow point
PA lamp light distribution pattern
PL low-beam light distribution pattern
R1, R2, R3, R4, R5, R6, R7 ridge line
T1, T2, T3, T4, T5 trough line
Z1, Z2, Z3 centrally inwards area

The invention claimed is:

1. A vehicular lamp comprising:
a light source; and
a lens disposed at a front side of the light source and configured to form a predetermined lamp light distribution pattern by controlling a deflection of light emitted from the light source,
wherein a front surface of the lens comprises a plurality of front surface areas defined by ridge lines,
wherein a rear surface of the lens comprises a plurality of rear surface areas defined by trough lines, and wherein a number of the plurality of rear surface areas equals to a number of the plurality of front surface areas,
wherein the front surface comprises:
a first plurality of front surface areas defined by a first set of ridge lines and provided at a center portion of the front surface; and
a second plurality of front surface areas defined by a second set of ridge lines and provided at a radial outer portion with respect to the first plurality of front surface areas, and
wherein the first plurality of front surface areas and the second plurality of front surface areas are concentric.

2. The vehicular lamp of claim 1, wherein the rear surface areas are formed so as to have surface shapes which are set so that all light of each light group emitted from the light source and then incident on each of the plurality of rear surface areas of the lens reaches each of respective plurality of front surface areas corresponding to the plurality of rear surface areas.

3. The vehicular lamp of claim 2, wherein the front surface areas are formed so as to have surface shapes which are set so that light which is emitted from a predetermined point and then reaches the front surface areas via the corresponding rear surface areas is emitted into predetermined directions from individual front surface areas.

4. The vehicular lamp of claim 3, wherein the lamp light distribution pattern is formed as a combined light distribution pattern of a plurality of light distribution patterns which are formed by a combination of individual rear surface areas and the individual front surface areas.

5. The vehicular lamp of claim 1, wherein the rear surface areas are formed so as to have surface shapes which are set so that all light of each light group emitted from the light source and then incident on each of the plurality of rear surface areas of the lens reaches a zone on each of respective plurality of front surface areas corresponding to the plurality of rear surface areas, and
wherein each zone corresponds to a region provided centrally inwards from the ridge lines which define the circumference of each of the front surface areas.

6. A vehicular lamp comprising:
a light source; and
a lens disposed at a front side of the light source and configured to form a predetermined lamp light distribution pattern by controlling a deflection of light emitted from the light source,
wherein a front surface of the lens comprises a plurality of front surface areas defined by ridge lines, wherein a rear surface of the lens comprises a plurality of rear surface areas defined by trough lines, and wherein a number of the plurality of rear surface areas equals to a number of the plurality of front surface areas, wherein the rear surface comprises:

a first plurality of rear surface areas defined by a first set of trough lines and provided at a center portion of the rear surface; and a second plurality of rear surface areas defined by a second set of trough lines and provided at a radial outer portion with respect to the first plurality of rear surface areas, and wherein the first plurality of rear surface areas and the second plurality of rear surface areas are concentric.

7. The vehicular lamp of claim 6, wherein the rear surface areas are formed so as to have surface shapes which are set so that all light of each light group emitted from the light source and then incident on each of the plurality of rear surface areas of the lens reaches each of respective plurality of front surface areas corresponding to the plurality of rear surface areas.

8. The vehicular lamp of claim 7, wherein the front surface areas are formed so as to have surface shapes which are set so that light which is emitted from a predetermined point and then reaches the front surface areas via the corresponding rear surface areas is emitted into predetermined directions from individual front surface areas.

9. The vehicular lamp of claim 8, wherein the lamp light distribution pattern is formed as a combined light distribution pattern of a plurality of light distribution patterns which are formed by a combination of individual rear surface areas and the individual front surface areas.

10. The vehicular lamp of claim 6, wherein the rear surface areas are formed so as to have surface shapes which are set so that all light of each light group emitted from the light source and then incident on each of the plurality of rear surface areas of the lens reaches a zone on each of respective plurality of front surface areas corresponding to the plurality of rear surface areas, and wherein each zone corresponds to a region provided centrally inwards from the ridge lines which define the circumference of each of the front surface areas.

* * * * *